US007299176B1

(12) United States Patent
Lee et al.

(10) Patent No.: US 7,299,176 B1
(45) Date of Patent: Nov. 20, 2007

(54) VOICE QUALITY ANALYSIS OF SPEECH PACKETS BY SUBSTITUTING CODED REFERENCE SPEECH FOR THE CODED SPEECH IN RECEIVED PACKETS

(76) Inventors: Yueh-ju Lee, 1082 Norfolk Dr., San Jose, CA (US) 95129; Shang-Pin Chang, 4227 Nerissa Cir., Fremont, CA (US) 94555; Phuong Luong, 1805 Cheney Dr., San Jose, CA (US) 95128; Hang Shi, 231 Dixon Landing Rd. Apt. 233, Milpitas, CA (US) 95035; Frank C. Lin, 12056 Jamestown Ct., Saratoga, CA (US) 95070; Yu-Lun Huang, 6F-1, No. 86 Ta-Hsueh Road, Hsinchu, 300 (TW)

( * ) Notice: Subject to any disclaimer, the term of this patent is extended or adjusted under 35 U.S.C. 154(b) by 883 days.

(21) Appl. No.: 10/251,702

(22) Filed: Sep. 19, 2002

(51) Int. Cl.
*G10L 21/00* (2006.01)

(52) U.S. Cl. ..... 704/228

(58) Field of Classification Search ..... 704/230, 704/231, 233; 714/747, 748, 749, 750, 751
See application file for complete search history.

(56) References Cited

U.S. PATENT DOCUMENTS 4,476,559 A * 10/1984 Brolin et al. ..... 370/522
5,737,365 A * 4/1998 Gilbert et al. ..... 375/224
5,812,534 A * 9/1998 Davis et al. ..... 370/260
5,940,479 A * 8/1999 Guy et al. ..... 379/93.01
6,009,082 A * 12/1999 Caswell et al. ..... 370/276
6,275,797 B1 * 8/2001 Randic ..... 704/233
6,289,003 B1 * 9/2001 Raitola et al. ..... 714/748
6,330,428 B1 * 12/2001 Lewis et al. ..... 704/230
6,910,168 B2 * 6/2005 Baker et al. ..... 714/751
7,061,903 B2 * 6/2006 Higuchi ..... 370/352
7,068,594 B1 * 6/2006 Tasker ..... 370/217
2002/0003799 A1 * 1/2002 Tomita ..... 370/392

OTHER PUBLICATIONS

International Telecommunication Union, ITU-T Telecommunication Standardization Sector of ITU, ITU-T Recommendation G.113, "*Transmission Systems and Media, General Characteristics of International Telephone Connections and International Telephone Circuits*", 1 cover page, 1 page Foreword, 2 pages Contents, 1 page Summary, 31 pages of text, Feb. 1996.

* cited by examiner

*Primary Examiner*—Tālivaldis Ivars Šmits

(57) ABSTRACT

A system and method for voice quality analysis include the ability to receive packets in a voice stream and to generate a receipt indicator for the packets. The system and method also include the ability to substitute a reference voice sample for the voice data in the packets and to compare the voice data in the voice-substituted packets to the reference voice sample to determine voice quality.

33 Claims, 3 Drawing Sheets

VOICE QUALITY ANALYSIS OF SPEECH PACKETS BY SUBSTITUTING CODED REFERENCE SPEECH FOR THE CODED SPEECH IN RECEIVED PACKETS

TECHNICAL FIELD OF THE INVENTION

This invention relates in general to communication systems, and, more particularly, to a system and method for voice quality analysis of communication systems.

BACKGROUND OF THE INVENTION

One type of network that has received considerable interest over the past several years for its voice conveyance capabilities is the packet data network. In such a network, sound at an origination point may be digitized, placed into packets, and sent across the network in the packets to a destination point, which may reproduce the sound based on the data in the packets.

Unfortunately, the packets in such a network may be sent at irregular intervals, sent by different routes, and/or discarded. This leads to voice packets arriving at irregular intervals, arriving in a different order, and/or not arriving at all relative to their generation at the origination point. Thus, voice quality may suffer.

Typical systems for assessing voice quality in a packet data network require recording a test voice stream at a destination point and generating a reference voice stream from a reference voice sample. The recorded voice stream and the generated voice stream may then be compared to determine the voice quality of the network.

This approach, however, requires an additional device in the network under test so that the test voice stream may be introduced. Furthermore, introducing the test voice stream requires coordination between the origination and destination points and produces extra load in the network, which corrupts the analysis. Additionally, by only being able to measure voice quality from the origination point to the destination point, isolating problems in the network is difficult.

SUMMARY OF THE INVENTION

The present invention provides a system and method that substantially reduce and/or eliminate at least some of the problems and/or disadvantages with existing systems and methods for voice quality analysis. To accomplish this, the present invention provides, at least in certain embodiments, a voice quality module that does not require a test stream to be introduced into the network.

In particular embodiments, a system for voice quality analysis includes a voice packet capture module, a voice data substitution module, and a voice quality analysis module. The voice packet capture module is operable to receive packets in a voice stream and to generate a receipt indicator for the packets. The voice data substitution module is operable to substitute a reference voice sample for the voice data in the packets. The voice quality analysis module is operable to compare the voice data in the voice-substituted packets to the reference voice sample to determine voice quality.

In certain embodiments, a method for voice quality analysis includes receiving packets in a voice stream and generating a receipt indicator for the packets. The method also includes substituting a reference voice sample for the voice data in the packets and comparing the voice data in the voice-substituted packets to the reference voice sample to determine voice quality.

The present invention has several technical features. For example, because a voice quality module may be coupled between an originating endpoint and a receiving endpoint, problems introduced by the receiving endpoint may be eliminated from the voice quality analysis. Furthermore, because a voice quality module may be coupled to a communication system at a variety of locations, problems with voice quality in the communication system may be isolated and/or identified. As another example, because a reference voice sample does not have to be introduced into a communication system for a voice quality module to perform its task, the operations of the system may not be disturbed by the analysis, leading to more accurate analysis. Moreover, by still being able to use a reference voice sample, privacy concerns are assuaged. As another example, a device does not have to be provided at one of the endpoints to introduce the reference voice stream into the communication system, which simplifies the analysis process. Moreover, the test stream introduction and recording do not have to be coordinated, which also simplifies the analysis process.

Of course, some embodiments may possess none, one, some, or all of these technical features and/or additional technical features. Other technical features will be readily apparent to those skilled in the art from the figures, detailed written description, and claims.

BRIEF DESCRIPTION OF THE DRAWINGS

The figures described below provide a more complete understanding of the present invention and its technical features, especially when considered with the following detailed written description.

DETAILED DESCRIPTION OF THE INVENTION

Figure 1:
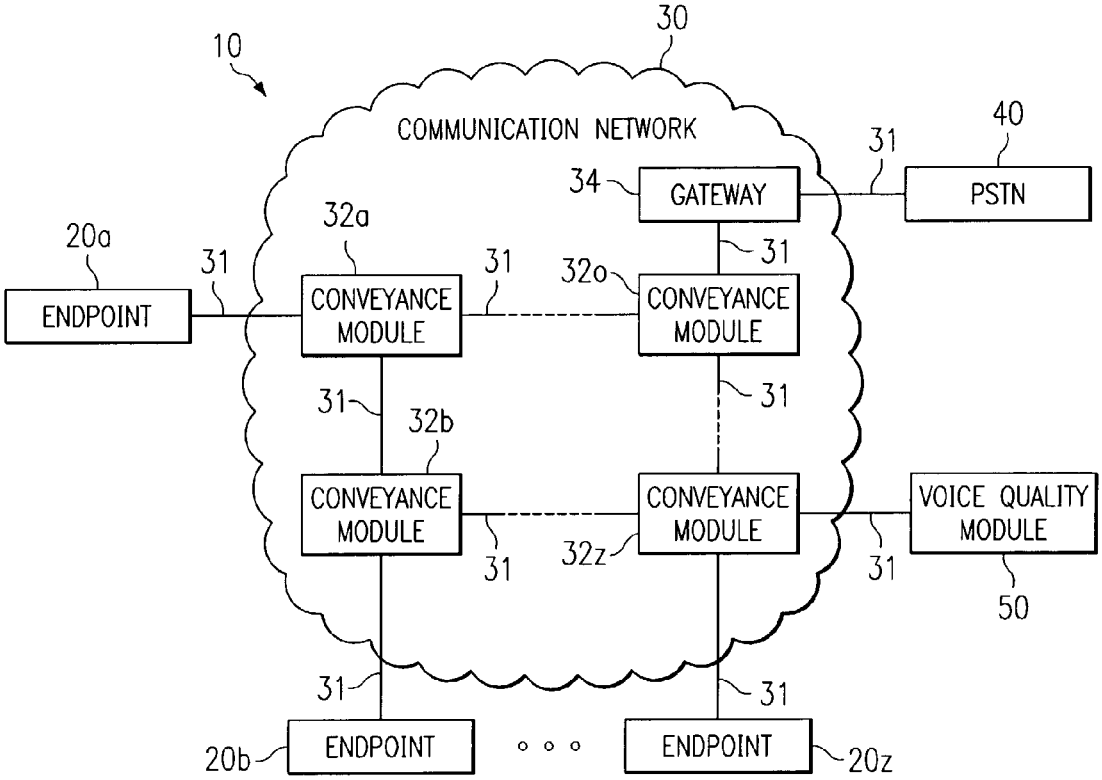
FIG. 1 illustrates a communication system in accordance with one embodiment of the present invention.

FIG. 1 illustrates a communication system 10 in accordance with one embodiment of the present invention. In general, communication system 10 includes endpoints 20, a communication network 30, and a voice quality module 50. Endpoints 20 generate and/or store voice data and convey it through communication network 30 in packets, a succession of related packets from one of endpoints 20 forming a voice-packet stream. Voice quality module 50, in turn, is able to analyze the effects that the conveyance has on the packets and, hence, the voice data.

In more detail, endpoints 20 may include telephones, voice-capable personal computers, personal computers, voice-capable personal digital assistants, personal digital assistants, a voice-mail storage and delivery system, and/or any other type of device for generating voice data, storing voice data, sending it to communication network 30, receiving it from communication network 30, and/or converting it to audible sound. If one of endpoints 20 generates voice data based on audible sound of a user, it will typically include a microphone to convert the audible sound into electrical signals, an encoder to convert the electrical signals to voice data, and a processor executing logical instructions to group the voice data into packets and send them to communication network 30. If one of endpoints 20 generates audible sound based on voice data, it will typically include a processor executing logical instructions to receive voice packets from communication network 30 and ungroup the voice data from the packets, a decoder to convert the voice data to electrical signals, and a speaker to convert the electrical signals to audible sound. In particular embodiments, endpoints 20 are telephones that utilize Internet protocol (IP) telephony techniques.

Communication network 30 provides the conveyance of the voice data packets between endpoints 20. To accomplish this, communication network 30 is coupled to endpoints 20 by links 31. Links 31 may be wires, cables, fiber-optic cables, microwave channels, infrared channels, or any other type of wireline or wireless path for conveying data. Additionally, communication network 30 includes conveyance modules 32. Conveyance modules 32 may be switches, routers, bridges, voice gateways, call managers, transceivers, hubs, and/or any other type of device for conveying data packets. Conveyance modules 32 are also coupled to each other by links 31, which may have intervening conveyance modules. Communication network 30 may operate according to any appropriate type of protocol, such as, for example, Ethernet, IP, X.25, frame relay, or any other packet data protocol. Note that communication network 30 may also support the conveyance of non-voice data packets between endpoints 20 and/or other devices.

Communication network 30 also includes a gateway 34, which is coupled to conveyance module 32*o* by one of links 31. Gateway 34 is operable to convert voice data packets in communication network 30 to a format suitable for a public switched telephone network (PSTN) 40 and/or to convert voice data from PSTN 40 to a format suitable for communication network 30. Thus, endpoints 20 may operate with standard telephony devices.

Voice quality module 50 is coupled to conveyance module 32*z* by one of links 31 in the illustrated embodiment, although it could be coupled to any of conveyance modules 32, or even one of endpoints 20. By being coupled to conveyance module 32*z*, voice quality module 50 is operable to receive packets from a voice-packet stream being conveyed by conveyance module 32*z* and to analyze the voice quality for the stream. To receive packets from a voice-packet stream, voice quality module 50 may, for example, tap a shared medium, such as, for example, an Ethernet connection or a wireless connection. The voice data in the packets may then be replaced by an encoded reference voice sample, and the packets analyzed using the encoded reference voice sample. Voice quality module 50 may include a communication interface, a processor, a memory, an encoder, a decoder, a voice synthesizer, a reference voice sample, a filter, an echo canceller, and/or any other components for receiving and analyzing packets for voice quality analysis. In particular embodiments, voice quality module 50 is a Linux-based PC with an Ethernet port.

In operation, when one of endpoints 20, endpoint 20*a*, for example, wishes to convey voice data to another of endpoints 20, endpoint 20*z*, for example, a session is established between the endpoints. A session may be established according to the real-time transfer protocol (RTP), the H.323 protocol, the Skinny protocol, or any other appropriate protocol. Then, endpoint 20*a* may begin to send packets containing voice data, which may or may not have been generated by endpoint 20*a*, to conveyance module 32*a* of communication network 30. Upon receiving the packets, conveyance module 32*a* routes the packets toward endpoint 20*z*. Typically, the route will be defined during establishment of the session, or conveyance module 32*a* may define the route. Sometimes, however, packets may take alternate routes. The packets are conveyed over links 31 and through conveyance modules 32 towards endpoint 20*z*.

When packets in the voice stream arrive at conveyance module 32*z*, voice quality module 50 may store the packets and their arrival characteristics in order to perform voice quality analysis. To determine which packets to analyze, voice quality module 50 may examine the destination address of the packets, the origination address of the packets, the arrival port of the packets, the type of data conveyed by the packets, and/or any other appropriate indicia. For example, using the destination address, voice conveyance module 50 may look for voice packets destined for a particular endpoint 30, on a particular local area network (LAN), or on a particular virtual LAN (VLAN). For instance, if voice quality module 50 is coupled to a catalyst switch, it may use the switch's spanning feature to record and analyze the voice streams on a VLAN. For a service provider environment, it may be beneficial to couple voice quality module 50 to an aggregation point or other device where network congestion is likely to occur. As another example, voice quality module 50 may look for signaling messages indicating that a call is being set up. This may be done upon command, at predetermined intervals, or upon any other appropriate criterion. The packets of interest may be stored along with their arrival characteristics, such as, for example, time of arrival, order of arrival, and/or any other appropriate arrival characteristics.

Once a sufficient number of packets of interest have been collected, perhaps indicated by the end of the voice stream from endpoint 20*a* to endpoint 20*z* or by a sufficient amount of voice data having been received, a reference voice sample may be substituted for the voice data in the collected packets. To accomplish this, the collected packets may be examined to determine the type of encoding, and possibly frame size and packetization, used for the voice data in the packets. The reference voice sample may then be encoded similarly, and the encoded reference voice sample may be substituted for the voice data in the packets, perhaps based on the size of each packet and the sequence in the voice stream. Note that if some packets are missing from the voice stream, the portion of the encoded reference voice sample associated with that packet may be discarded.

The packets with the encoded reference voice sample may be processed as if they were the actual packets arriving from endpoint 20*a*, with the jitter, packet losses, and/or packet ordering that occurred prior to arriving at voice quality module 50. For example, the voice data in the packets may be decoded, synthesized, and compared to the reference voice sample to obtain a voice quality analysis. The voice quality analysis may be made according to perceptual speech quality measurement (PSQM) techniques, such as, for example, those described in ITU-T P.861, or any other appropriate technique. Results of the analysis, such as, for example, signaling events (e.g., call setup and disconnect), statistics (e.g., jitter, drop, order), a voice quality score, or any other appropriate data, may be conveyed to a user by display device, acoustic device, electronic message, and/or other appropriate technique and/or stored for later retrieval. In particular embodiments, the results are conveyed if a threshold is broken, such as, for example, a high PSQM score. In certain embodiments, a representation of the reference voice sample or the voice data in the packets may also be output and/or sent to a user.

As illustrated in FIG. 1, the present invention has several technical features. For example, because voice quality module 50 may be coupled between endpoints 20, problems introduced by the receiving endpoint may be eliminated from the voice quality analysis. Furthermore, because voice quality module 50 may be coupled to communication network 30 at a variety of locations, voice quality module 50 may provide enhanced location and/or identification of problems with voice quality in communication network 30. In particular embodiments, a number of voice quality modules like voice quality module 50 could be used in system 10 to enhance location and/or identification of problems with voice quality. As another example, because a reference voice sample does not have to be introduced into communication network 30 for voice quality module 50 to perform its task, the operations of the network may not be disturbed by the analysis, leading to more accurate results. Moreover, by still being able to use a reference voice sample, privacy concerns are assuaged. As another example, a device does not have to be provided at one of endpoints 20 to introduce the reference voice stream into communication network 30, which simplifies the analysis process. Moreover, test stream introduction and recording do not have to be coordinated, which also simplifies the analysis process. A variety of other technical features exist.

Although FIG. 1 illustrates one embodiment of a communication system in accordance with the present invention, other embodiments may include fewer, more, and/or a different arrangement of components. For example, certain embodiments may not include gateway 40. As an additional example, in some embodiments, one, some, or all of endpoints 20 and voice quality module 50 may be part of communication network 30. As another example, voice quality module 50 may be part of one of conveyance modules 32 or of one of endpoints 20. As an additional example, some embodiments may include other devices, such as non-voice-enabled computers, servers, or workstations, that use communication network 30 to convey data. In particular embodiments, voice quality module 50 may be coupled to a communication system at any of a variety of points, such as, for example, conveyance modules, links, endpoints, or gateways, allowing enhanced location and/or identification of problems with voice quality. Moreover, the communication system may include a variety of voice quality modules such as voice quality module 50, which may again improve voice quality analysis. For instance, by examining the analysis from two such modules, voice quality information over a section may be determined, and, if the modules have synchronized clocks, delay measurements may be determined. A variety of other examples exist.

Note that voice quality module 50 may suffer from several drawbacks. For example, if a tap is not perfect, voice packets may be missed, and, hence, voice quality may be undercomputed. As another example, even if the tap is perfect, routing flaps or load splitting might cause some voice packets to be conveyed by alternate routes, which may bypass the tap, leading to an effect similar to the one just mentioned. As a further example, in encoding schemes where the packet type does not reflect the encoding, the encoding of the data may have to be estimated, or the signaling messages for the session between endpoints may have to be tapped. The former is error prone, and the latter may be difficult because the signaling may go by a different path or may be encrypted. In particular embodiments, however, voice quality module 50 may run in a distributed mode in which it examines both a signaling channel and a bearer channel. As an additional example, the arrival characteristics of the voice packets may only reflect the conditions in communication system 10 upstream of the tap. Thus, conditions in communication system 10 downstream of the tap may not be reflected by the voice quality analysis. As another example, accurate emulation of an adaptive jitter algorithm may be imperfect because of sensitivity of the algorithm to initial conditions and other timing-related problems. As a further example, encrypted RTP packets may be difficult to interpret correctly since the packet type is inside the encrypted envelope; of course, time sequence and sequence number are probably in the clear, so the basic tap information is still available. Even with these potential drawbacks, however, the various embodiments of the present invention have advantages, some of which have been mentioned previously.

Figure 2:
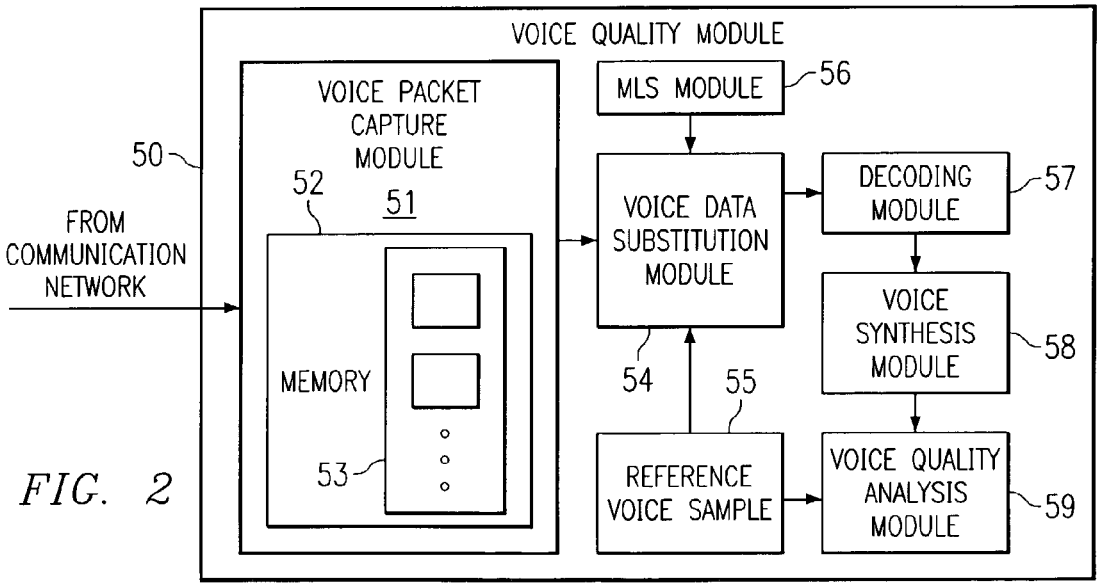
FIG. 2 illustrates one embodiment of a voice quality module for the communication system of FIG. 1.

FIG. 2 illustrates one embodiment of voice quality module 50. As illustrated, this embodiment of voice quality module 50 includes a voice packet capture module 51, a voice data substitution module 54, a reference voice sample 55, a maximum length sequence (MLS) module 56, a decoding module 57, a voice synthesis module 58, and a voice quality analysis module 59.

Voice packet capture module 51 receives packets from communication network 30, determines whether the packets are of interest, and, if they are of interest, stores them and their associated arrival characteristics in a memory 52, which is a type of computer readable media. To determine whether a packet is of interest, voice packet capture module 51 may examine the destination address of the packet, the origination address of the packet, the type of data in the packet, the arrival port of the packet, and/or any other appropriate criterion that indicates the packet is part of a voice stream. If a packet is of interest, voice packet capture module 51 stores the packet and its associated arrival characteristics in a location 53 in memory 52. Voice packet capture module 51 continues to examine packets and store those of interest in location 53 until a sufficient number of packets have been received. A sufficient number of packets may be received, for example, if there are no more packets in a voice stream or if voice data representing a predetermined period of time, such as, for example sixty seconds, has been received.

In particular embodiments, voice packet capture module 51 may include a communication interface, such as, for example, a network interface card, a transceiver, a modem, and/or a port, and a processor operating according to logical instructions, such as, for example, a microprocessor, a field programmable gate array (FPGA), an application specific integrated circuit (ASIC), and/or any other type of device for manipulating data in a logical manner. The instructions for the processor could be stored in memory 52. Furthermore, memory 52 may include read-only memory (ROM), random access memory (RAM), compact-disk read-only memory (CD-ROM), registers, and/or any other type of volatile or non-volatile electromagnetic or optical data storage service. In general, voice packet capture module 51 may be any type of device that can receive, examine, and store packets from communication network 30.

Voice data substitution module 54 replaces the voice data in the packets of interest with voice data of reference voice sample 55, which may be a WAV file, an AU file, or any other storable representation of audible sound. To accomplish this, voice data substitution module 54 examines the packets to determine the type of encoding used for the voice data, such as, for example, G.711, G.726, or G.729. For example, if the packets are sent using RTP, they may indicate the type of encoding used in the RTP header. As another example, the payload type and payload length for the packets, which may be in another header, may be examined to determine the encoding scheme. Voice data substitution module 54 may then encode reference voice sample 55 according to a similar encoding scheme and substitute the encoded reference voice sample for the voice data in the packets of interest, perhaps by using the sequence number of the packets. In doing this, voice data substitution module 54 may have to discard some of the encoded reference voice sample because of missing voice packets. Also, voice data substitution module 54 may truncate or recycle reference voice sample 55, depending on the length of the voice stream to be analyzed. Voice data substitution module 54 may then output the packets, which now contain the encoded reference voice sample instead of the original voice data, according to their arrival characteristics to decoding module 57.

In particular embodiments, voice data substitution module 54 includes a processor operating according to logical instructions encoded in a memory. In general, however, voice data substitution module 54 may be any type of device that can examine voice packets and substitute an encoded reference voice sample for the voice data in the packets.

MLS module 56 provides a pseudo-random code that voice data substitution module 54 may use to align the encoded reference voice sample with the reference voice sample. For example, voice data substitution module 54 may place the code in the first packet(s) in the voice stream to align the encoded reference with the reference.

Decoding module 57 decodes the voice data, which is now the encoded reference voice sample, in the packets. In accomplishing this, the decoding module 57 may determine the type of encoding used on the voice data in the packets, apply a jitter buffer to the packets, and decode the voice data. Note that decoding module 57 may discard packets if they are too far out of order. Decoding module 57 passes the decoded voice data to voice synthesis module 58.

In particular embodiments, decoding module 57 includes a processor operating according to logical instructions encoded in a memory and operates similarly to one of endpoints 30. In general, however, decoding module 57 may be any type of device for decoding voice data.

Voice synthesis module 58 is responsible for converting the decoded voice data into a voice synthesized format. For example, voice synthesis module 58 may convert the decoded voice data into a WAV or an AU file. In particular embodiments, voice synthesis module 58 may be an audio format converter. In general, voice synthesis module 58 may be any type of device for synthesizing sound.

After conversion of the decoded voice data into a voice synthesized format, voice quality analysis module 59 may compare the synthesized voice data to the reference voice sample 55 to perform a voice quality analysis. For example, voice quality analysis module 59 may use perceptual speech quality management (PSQM) techniques to determine voice quality. The results of such an analysis may be output to a user by a display device, an acoustic device, an electronic message, and/or any other suitable communication technique.

In particular embodiments, voice quality analysis module 59 may be a PESQ, PAMS, or SNR calculator. In general, however, voice quality analysis module 59 may be any device that can compare audible sound.

Although FIG. 2 illustrates one embodiment of voice quality module 50, other embodiments may have fewer, more, and/or a different arrangement of components and/or fewer, more, and/or a different ordering of functions. For example, in certain embodiments, the reference voice sample may be apriori encoded according to the same scheme as the voice data in the packets of interest. Thus, voice data substitution module 54 may not have to encode the reference voice sample. As an additional example, in some embodiments, the encoded reference voice sample may be compared to the voice data in the packets after substitution of the encoded reference voice sample for the voice data in the packets. Thus, the voice data in the packets does not have to be decoded and synthesized. As another example, in certain embodiments, voice quality module 50 may analyze more than one voice stream at a time. As another example, certain embodiments may not include MLS module 56. As an additional example, decoding module 57 may process the voice packets according to the receipt characteristics. Thus, the packets do not have to be output from module 54 according to the receipt characteristics. As a further example, although voice quality module 50 has been illustrated as including voice packet capture module 51, voice data substitution module 54, reference voice sample 55, MLS module 56, decoding module 57, voice synthesis module 58, and voice quality analysis module 59, in other embodiments, some or all of the functions of the modules may be performed by a processor implementing a set of logical instructions. For instance, a processor implementing logical instructions, which may be encoded in an appropriate form of computer readable media, may be able to perform some or all of the functions of voice packet capture module 51, voice data substitution module 54, MLS module 56, decoding module 57, voice synthesis module 58, and voice quality analysis module 59. As another example, in some embodiments, instead of replacing the actual voice data with the reference voice sample, the process can be reversed such that the actual voice payload is used to generate the reference voice sample. Once the reference voice sample is generated, the voice quality analysis module may be used to analyze the particular conversation. This may be particularly useful where a user want to find out how voice quality differs with different voice samples. A variety of other examples exist.

Figure 3:
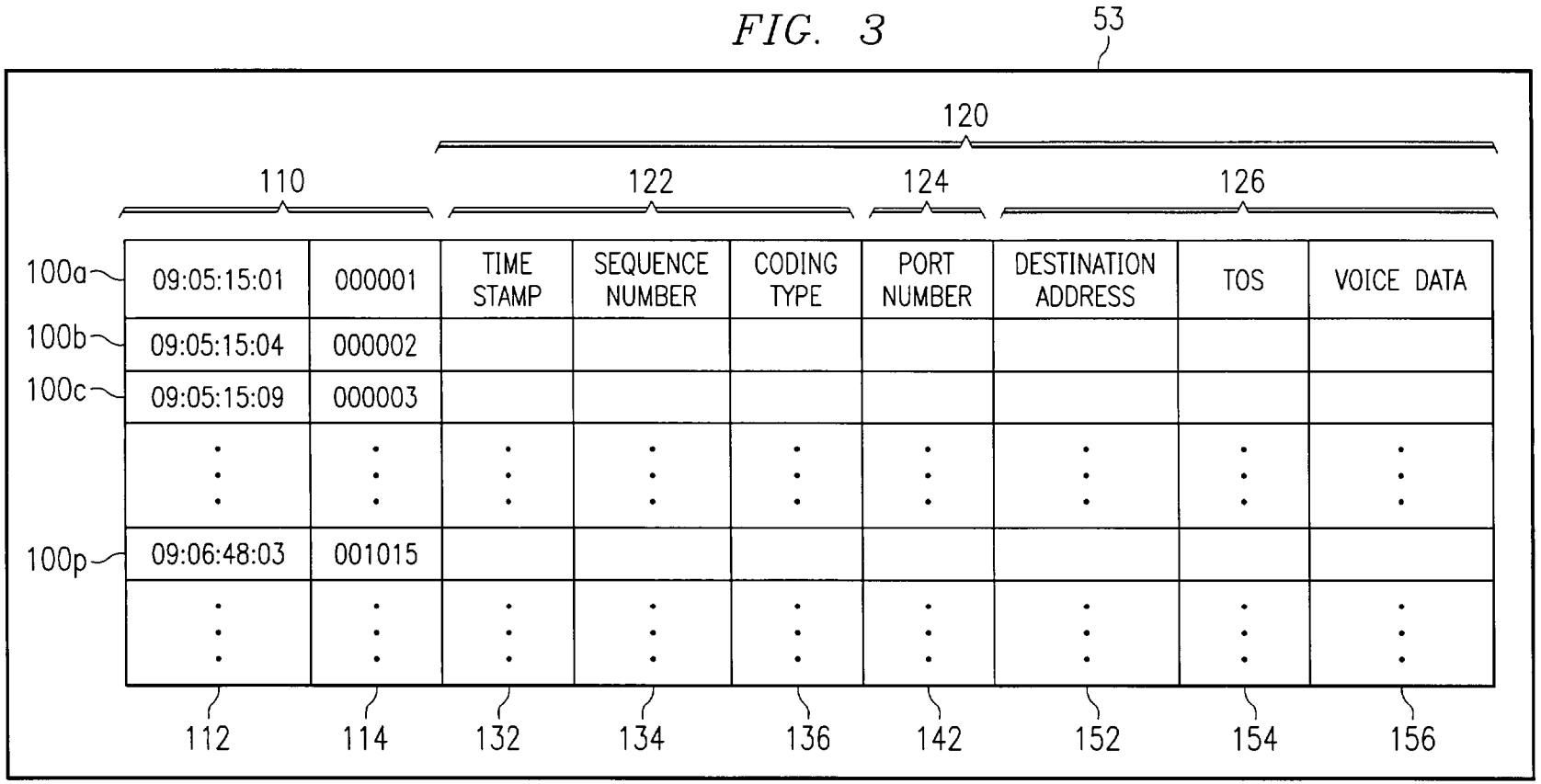
FIG. 3 illustrates a portion of memory for the voice quality module of FIG. 2.

FIG. 3 illustrates one embodiment of location 53 in memory 52 of voice packet capture module 51. As mentioned previously, location 53 stores voice packets of interest and their associated receipt characteristics. In this embodiment, location 53 includes records 100, each of which corresponds to a received, analyzed, and stored voice packet. Furthermore, each of records 100 includes a receipt indicator section 110 and a voice packet section 120.

Receipt indicator section 110 includes a time stamp field 112 and a sequence number field 114. Time stamp field 112 contains an indication of the time at which the associated voice packet arrived at voice packet capture module 51. As illustrated, time stamp field 112 indicates the hour, minute, second, and hundredth of a second at which a packet was received. The data in field 112 may be useful, among other things, for determining the jitter of the voice packets. Sequence number field 114 contains an indication of the sequence in which the associated voice packet arrived at voice packet capture module 51. The data in field 114 may be useful, among other things, for determining the order in which voice packets arrived at voice packet capture module 51.

Voice packet section 120 includes an RTP section 122, a user datagram protocol (UDP) section 124, and an IP packet section 126. RTP section 122 includes a time stamp field 132, a sequence number field 134, and a coding type field 136. Time stamp field 132 contains an indication of when the associated voice data was processed. Field 132 may be useful in determining jitter and/or determining whether packets are missing from the voice stream. Sequence number field 134 contains an indication of where the associated voice data belongs in the voice stream. Field 134 may be useful in determining jitter, determining whether packets are missing from the voice stream, and/or determining the proper order of voice packets. Furthermore, the data may be useful for associating the encoded reference voice sample with the appropriate voice packets. Coding type field 136 contains an indication of the type of encoding scheme used for the voice data. For example, data that represents audible sounds may be encoded using G.711, G.726, or G.729. As mentioned previously, by examining the data in field 136, the type of encoding used for the voice data may be determined and used for encoding the reference voice sample. UDP section 124 includes a port number field 142. Port number field 142 contains an indication of the port for which the voice packet is destined at the receiving device. Field 142 may be useful in identifying packets of interest. IP packet section 126 includes a destination address field 152, a type of service (TOS) field 154, and a voice data field 156. Destination address field 152 contains an indication of the destination of the voice packet, such as, for example, an IP address. Field 152 may be useful in identifying packets of interest. TOS field 154 contains an indication of the type of data that the packet is carrying. For example, the data in field 154 may indicate that the packet is carrying general data, audio data, video data, low priority data, high priority data, or any other type of data. In some embodiments, by examining TOS field 154 and the size of the voice data, an indication of the encoding for the voice data may be obtained. Voice data field 156 contains the actual voice data that is being conveyed. Field 156 may be encoded according to G.711, G.726, G.729, or any other appropriate format.

Although one embodiment of location 53 in memory 52 is illustrated by FIG. 3, other embodiments may contain more, less, and/or a different arrangement of data. For example, in particular embodiments, field 114 may be eliminated. As another example, in certain embodiments, the captured voice packet may not contain field 134, field 136, and/or field 154. Moreover, parts of the packet may be encrypted. As a further example, in some embodiments, the fields may not be arranged in a tabular format, instead being related by link lists, relational databases, hierarchical databases, or any other arrangement of data. In particular embodiments, field 156 may be eliminated, especially if an indicia of the amount of voice data in the field is generated. A variety of other examples exist.

Figure 4:
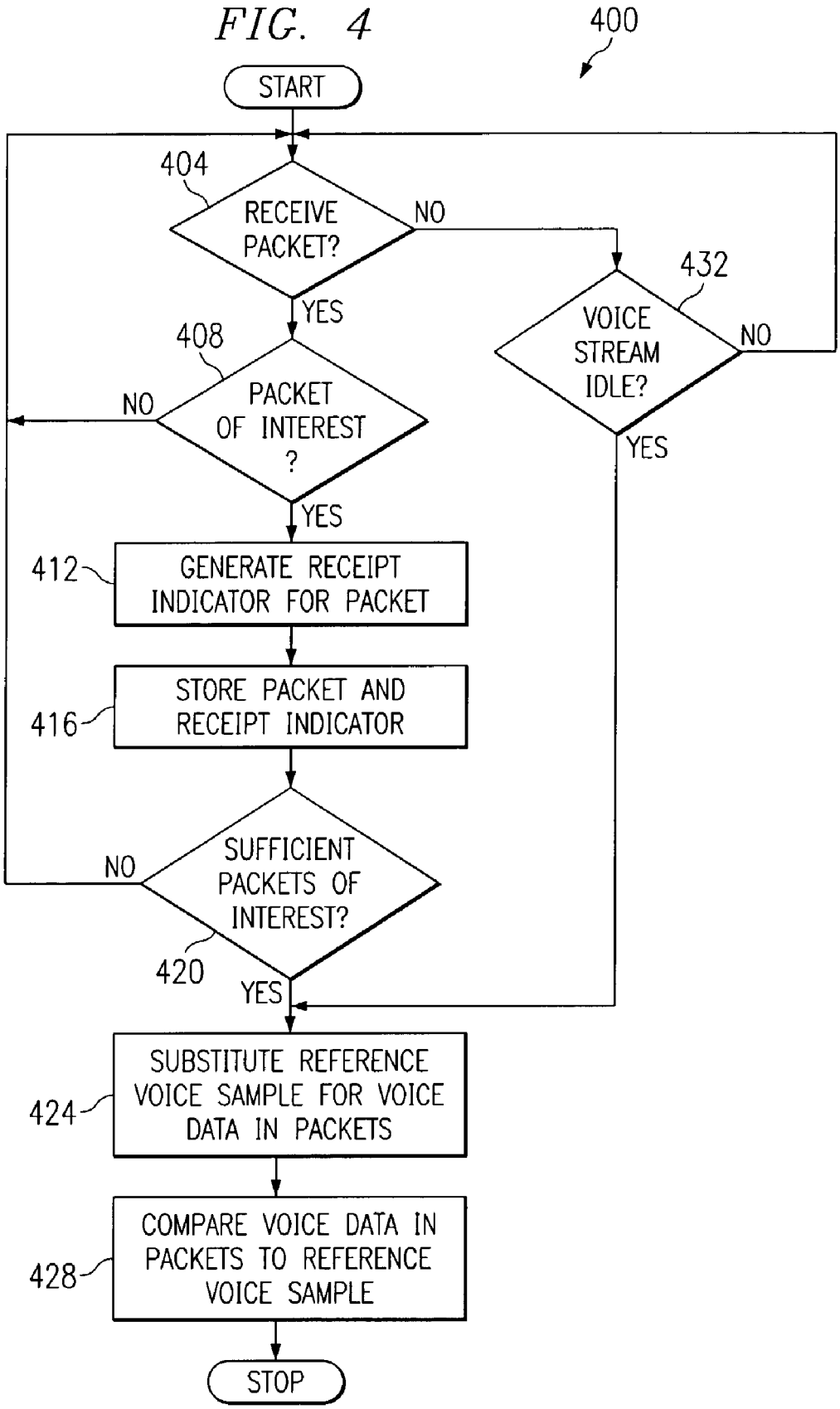
FIG. 4 illustrates a method for voice quality analysis in accordance with one embodiment of the present invention.

FIG. 4 is a flowchart 400 that illustrates a method for voice quality analysis in accordance with one embodiment of the present invention. The method begins at decision block 404 with determining whether a packet has been received. Received packets may be streaming voice packets, streaming data packets, data packets, or any other type of packets.

Once a packet has been received, the method calls for determining whether the packet is of interest at decision block 408. A packet may be of interest, for example, if it is carrying voice data, is destined for a particular endpoint, originates from a particular endpoint, destined for a particular port, and/or contains any other appropriate voice-stream indicia. If the packet is not of interest, the method returns to decision block 404 to check whether another packet has been received. If, however, the packet is of interest, the method calls for generating a receipt indicator for the packet at function block 412. As discussed previously, the receipt indicator may indicate the time that the packet was received, the sequence in which the packet was received, and/or any other appropriate receipt characteristic. At function block 416, the method calls for storing the packet and the receipt indicator. For example, the packet and receipt indicator may be stored in a location of a memory.

After this, the method calls for determining whether a sufficient number of packets of interest have been received at decision block 420. A sufficient number of packets of interest may have been received, for example, if a predetermined amount of a voice stream, such as, for instance, sixty seconds, is represented by the packets of interest or if there are no more packets in a voice stream. If a sufficient number of packets of interest have not been received, the method returns to decision block 404 to check whether another packet has been received.

If, however, a sufficient number of packets of interest have been received, the method calls for substituting a reference voice sample for the voice data in the packets at function block 424. As discussed previously, this may include: 1) determining the type of encoding used for the voice data in the packets; 2) encoding the reference voice sample using the identified encoding type; and 3) substituting the encoded reference voice sample for the voice data in the packets. The method then calls for comparing the voice data, which is now the encoded reference voice sample, in the packets to the reference voice sample at function block 428. As discussed previously, this may include decoding the voice data in the packets, generating a voice synthesis of the decoded data, and comparing the generated voice synthesis to the reference voice sample using PSQM techniques. After this, the method is at an end.

Returning to decision block 404, if a packet has not been received, the method calls for determining whether a voice stream is idle at decision block 432. A voice stream may be idle, for example, if no packets have been received from it in thirty seconds. If a voice stream is not idle, the method calls for returning to decision block 404. If, however, a voice stream is idle, the method calls performing the voice quality analysis operations discussed previously, beginning at function block 424.

Although flowchart 400 illustrates one embodiment of a method for voice quality analysis, other embodiments may include fewer, more, and/or a different arrangement of operations. For example, if packets are prescreened to identify those of interest, decision block 408 may be eliminated. As another example, the receipt indicator may be generated upon receipt of a packet and stored with the packet before determining whether the packet is of interest. As an additional example, a particular voice stream may need to be identified at the beginning of the method to determine which packets are of interest. As a further example, a plurality of voice streams may be analyzed simultaneously, meaning that the packets from the different voice streams will have to be identified separately from each other. A variety of other examples exist.

While a variety of embodiments have been discussed for the present invention, a variety of additions, deletions, modifications, and/or substitutions will be readily suggested to those skilled in the art. It is intended, therefore, that the following claims encompass such additions, deletions, modifications, and/or substitutions to the extent that they do not do violence to the spirit of the claims.

What is claimed is:

1. A system for voice quality analysis, comprising:

a voice packet capture module operable to receive packets in a voice stream and to generate a receipt indicator for the packets;

a voice data substitution module operable to substitute a reference voice sample for voice data in the packets, and a voice quality analysis module operable to compare the voice data in the voice-substituted packets to the reference voice sample to determine voice quality;

wherein, to substitute a reference voice sample for the voice data in the packets, the voice data substitution module is operable to:

determine an encoding scheme used for the voice data in the packets;

encode the reference voice sample according to the determined encoding scheme; and associate portions of the encoded reference voice sample with the packets.

2. The system of claim 1, wherein the packets comprise Internet protocol packets.

3. The system of claim 1, wherein the voice data is encoded according to G.711.

4. The system of claim 1, wherein the receipt indicator comprises a time stamp and a sequence number.

5. The system of claim 1, wherein the voice packet capture module is further operable to:

determine whether a packet is of interest; and retain the packet if it is of interest.

6. The system of claim 5, wherein the voice packet capture module is operable to examine a destination address of the packet to determine whether a packet is of interest.

7. A system for voice quality analysis, comprising:

a voice packet capture module operable to receive packets in a voice stream and to generate a receipt indicator for the packets;

a voice data substitution module operable to substitute a reference voice sample for voice data in the packets, and a voice quality analysis module operable to compare the voice data in the voice-substituted packets to the reference voice sample to determine voice quality;

a decoding module operable to receive the voice-substituted packets according to an order and timing in which they were received by the voice packet capture module and to decode the voice data in the packets; and a voice synthesis module operable to generate a synthetic voice sample based on the decoded data;

wherein the voice quality analysis module is operable to compare the synthetic voice sample to the reference voice sample to compare the voice data in the packets to the reference voice sample.

8. The system of claim 7, wherein the decoding module is further operable to compensate, at least in part, for jitter in the voice-substituted packets.

9. The system of claim 7, wherein the voice quality analysis module implements perceptual speech quality measurement techniques to compare the synthetic voice sample to the reference voice sample.

10. A method for voice quality analysis, comprising:

receiving packets in a voice stream;

generating a receipt indicator for the packets;

substituting a reference voice sample for voice data in the packets; and comparing the voice data in the voice-substituted packets to the reference voice sample to determine voice quality;

wherein substituting a reference voice sample for the voice data in the packets comprises:

determining an encoding scheme used for the voice data in the packets;

encoding the reference voice sample according to the determined encoding scheme; and associating portions of the encoded reference voice sample with the packets.

11. The method of claim 10, wherein the packets comprise Internet protocol packets.

12. The method of claim 10, wherein the voice data is encoded according to G.711.

13. The method of claim 10, wherein the receipt indicator comprises a time stamp and a sequence number.

14. The method of claim 10, further comprising:

determining whether a packet is of interest; and retaining the packet if it is of interest.

15. The method of claim 14, wherein determining whether a packet is of interest comprises examining a destination address of the packet.

16. The method of claim 10, wherein associating portions of the encoded reference voice sample with the packets comprises:

determining that a packet is missing from the voice stream; and discarding the associated portion of the encoded reference voice sample.

17. A method for voice quality analysis, comprising:

receiving packets in a voice stream;

generating a receipt indicator for the packets;

substituting a reference voice sample for voice data in the packets; and comparing the voice data in the voice-substituted packets to the reference voice sample to determine voice quality;

wherein comparing the voice data in the voice-substituted packets to the reference voice sample comprises:

generating a stream of the packets according to an order and timing in which they were received;

compensating, at least in part, for jitter in the packets;

decoding the voice data in the packets;

generating a synthetic voice sample based on the decoded data; and comparing the synthetic voice sample to the reference voice sample.

18. The method of claim 17, wherein comparing the synthetic voice sample to the reference voice sample comprises implementing perceptual speech quality measurement techniques.

19. A set of logic for voice quality analysis, the logic encoded in a computer readable medium and operable to:

receive packets in a voice stream;

generate a receipt indicator for the packets;

substitute a reference voice sample for voice data in the packets; and compare the voice data in the voice-substituted packets to the reference voice sample to determine voice quality;

wherein, to substitute a reference voice sample for the voice data in the packets, the logic is operable to:

determine an encoding scheme used for the voice data in the packets;

encode the reference voice sample according to the determined encoding scheme; and associate portions of the encoded reference voice sample with the packets.

20. The logic of claim 19, wherein the receipt indicator comprises a time stamp and a sequence number.

21. The logic of claim 19, wherein the logic is further operable to:

determine whether a packet is of interest; and retain the packet if it is of interest.

22. The logic of claim 21, wherein the logic is operable to examine a destination address of the packet to determine whether a packet is of interest.

23. The logic of claim 19, wherein, to associate portions of the encoded reference voice sample with the packets, the logic is operable to:

determine that a packet is missing from the voice stream; and discard the associated portion of the encoded reference voice sample.

24. A set of logic for voice quality analysis, the logic encoded in a computer readable medium and operable to:

receive packets in a voice stream;

generate a receipt indicator for the packets;

substitute a reference voice sample for voice data in the packets; and compare the voice data in the voice-substituted packets to the reference voice sample to determine voice quality;

wherein, to compare the voice data in the voice-substituted packets to the reference voice sample, the logic is operable to:

generate a stream of the packets according to an order and timing in which they were received;

compensate, at least in part, for jitter in the packets;

decode the voice data in the packets;

generate a synthetic voice sample based on the decoded data; and compare the synthetic voice sample to the reference voice sample.

25. The logic of claim 24, wherein, to compare the synthetic voice sample to the reference voice sample, the logic is operable to implement perceptual speech quality measurement techniques.

26. A system for voice quality analysis, comprising:

means for receiving packets in a voice stream;

means for generating a receipt indicator for the packets;

means for substituting a reference voice sample for voice data in the packets; and means for comparing the voice data in the voice-substituted packets to the reference voice sample to determine voice quality;

wherein substituting a reference voice sample for the voice data in the packets comprises:

determining an encoding scheme used for the voice data in the packets;

encoding the reference voice sample according to the determined encoding scheme; and associating portions of the encoded reference voice sample with the packets.

27. The system of claim 26, wherein the receipt indicator comprises a time stamp and a sequence number.

28. The system of claim 26, wherein the means for receiving packets in a voice stream is further operable to:

determine whether a packet is of interest; and retain the packet if it is of interest.

29. The system of claim 28, wherein determining whether a packet is of interest comprises examining a destination address of the packet.

30. The system of claim 26, wherein associating portions of the encoded reference voice sample with the packets comprises:

determining that a packet is missing from the voice stream; and discarding the associated portion of the encoded reference voice sample.

31. A system for voice quality analysis, comprising:

means for receiving packets in a voice stream;

means for generating a receipt indicator for the packets;

means for substituting a reference voice sample for voice data in the packets; and means for comparing the voice data in the voice-substituted packets to the reference voice sample to determine voice quality;

wherein comparing the voice data in the voice-substituted packets to the reference voice sample comprises:

generating a stream of packets according to an order and timing in which they were received;

compensating, at least in part, for jitter in the packets;

decoding the voice data in the packets;

generating a synthetic voice sample based on the decoded data; and comparing the synthetic voice sample to the reference voice sample.

32. The system of claim 31, wherein comparing the synthetic voice sample to the reference voice sample comprises implementing perceptual speech quality measurement techniques.

33. A system for voice quality analysis, comprising:

a voice packet capture module operable to receive voice packets, to determine whether a packet is of interest, to retain a packet if it is of interest, and to generate a time stamp and a sequence number for a retained packet;

a voice data substitution module operable to substitute a reference voice sample for the voice data in the retained packets, wherein substituting a reference voice sample comprises determining the encoding scheme used for the voice data in the retained packets, encoding the reference voice sample according to the determined encoding scheme, and associating portions of the encoded reference voice sample with the packets;

a decoding module operable to receive the voice-substituted packets according to the order and timing in which they were received by the voice packet capture module, to remove at least part of the jitter from the packets, and to decode the voice data in the packets;

a voice synthesis module operable to generate a synthetic voice sample based on the decoded data; and a voice quality analysis module operable to compare the synthetic voice sample to the reference voice sample using perceptual speech quality techniques to determine voice quality.

* * * * *

UNITED STATES PATENT AND TRADEMARK OFFICE

CERTIFICATE OF CORRECTION

PATENT NO. : 7,299,176 B1
APPLICATION NO. : 10/251702
DATED : November 20, 2007
INVENTOR(S) : Yuch-ju Lee et al.

It is certified that error appears in the above-identified patent and that said Letters Patent is hereby corrected as shown below:

Title page, after "(76) Inventors" insert item --73 Assignee: Cisco Technology, Inc., San Jose, CA--

Signed and Sealed this

Twentieth Day of May, 2008

JON W. DUDAS
*Director of the United States Patent and Trademark Office*